US010895349B2

(12) United States Patent
Hyatt

(10) Patent No.: US 10,895,349 B2
(45) Date of Patent: Jan. 19, 2021

(54) NANOPARTICLES FOR USE WITH DRAG REDUCER ADDITIVES AND METHOD OF USE

(71) Applicant: Robert Hyatt, Humble, TX (US)

(72) Inventor: Robert Hyatt, Humble, TX (US)

( * ) Notice: Subject to any disclaimer, the term of this patent is extended or adjusted under 35 U.S.C. 154(b) by 282 days.

(21) Appl. No.: 15/901,501

(22) Filed: Feb. 21, 2018

(65) Prior Publication Data

US 2018/0238497 A1 Aug. 23, 2018

Related U.S. Application Data

(60) Provisional application No. 62/462,639, filed on Feb. 23, 2017.

(51) Int. Cl.
*F17D 1/17* (2006.01)

(52) U.S. Cl.
CPC ..... *F17D 1/17* (2013.01)

(58) Field of Classification Search
CPC ..... F17D 3/12; F17D 1/17
See application file for complete search history.

(56) References Cited

U.S. PATENT DOCUMENTS

| | | | | |
|---|---|---|---|---|
| 3,596,437 | A | 8/1971 | Styring, Jr. et al. | |
| 5,220,938 | A | 6/1993 | Kley | |
| 7,018,434 | B2 * | 3/2006 | Waynick | G01N 33/2835 210/728 |
| 7,261,747 | B2 | 8/2007 | Waynick | |
| 7,364,599 | B2 * | 4/2008 | Waynick | C10G 25/00 44/457 |
| 7,897,063 | B1 | 3/2011 | Perry et al. | |
| 8,241,517 | B2 | 8/2012 | Fuchs et al. | |
| 8,252,259 | B2 | 8/2012 | Seal et al. | |
| 2010/0154893 | A1 | 6/2010 | Johnston et al. | |
| 2012/0211428 | A1 | 8/2012 | Zahn et al. | |
| 2013/0186473 | A1 | 7/2013 | Mankame et al. | |
| 2013/0327409 | A1 | 12/2013 | Silpe | |

* cited by examiner

*Primary Examiner* — Cephia D Toomer
(74) *Attorney, Agent, or Firm* — Head, Johnson, Kachigian & Wilkinson, PC

(57) ABSTRACT

Nanoparticles may be used in the formulation of long chain poly-alpha-olefins, commercially known as Drag Reducer Additives ("DRA"). These nanoparticles may be embedded in the original DRA formulation and/or added at some point in the pipeline application so they can then be used to destroy the DRA polymer by cleaving, interrupting or restructuring the DRA or otherwise breaking its bonds or to agglomerate or coagulate the polymer so it can be removed mechanically or chemically.

7 Claims, No Drawings

NANOPARTICLES FOR USE WITH DRAG REDUCER ADDITIVES AND METHOD OF USE

CROSS-REFERENCE TO RELATED APPLICATIONS

This application is based on and claims priority to U.S. Provisional Patent Application Ser. No. 62/462,639 filed Feb. 23, 2017.

BACKGROUND OF THE INVENTION

Field of the Invention

This invention relates generally to drag reducer additives ("DRA") and more particularly, but not by way of limitation, to nanoparticles either embedded in the DRA or added at some point in the pipeline application, where the nanoparticles may be used to destroy the DRA or allow the DRA to be removed.

Description of the Related Art

Long chain poly-alpha-olefins, commercially known as drag reducer additives ("DRA") are used in in crude oil, gasoline, and diesel fuel to reduce pressure losses in the pipe, thereby allowing the pipeline operator to transport more oil at lower pressures and lower operating costs. There are, however, restrictions on how much of the very heavy long chain polymer DRA that can be used in motor fuels. Furthermore, DRA is not allowed in any aviation fuel because the polymer is so large.

Based on the foregoing, it is desirable to provide a nanoparticle that may be included in the DRA molecule itself or as a catalyst that would allow the DRA to either be destroyed/reduced to an insignificant size or removed altogether, thus eliminating the restrictions on its use.

SUMMARY OF THE INVENTION

In general, in a first aspect, the invention relates to a nanoparticle for use with a drag reducing agent, where the nanoparticle is capable of altering the physical characteristics of the drag reducing agent. The nanoparticle may be capable of breaking down the drag reducing agent to a smaller size. Alternately, the nanoparticle may be capable of causing the drag reducing agent to agglomerate for removal from a carrier fluid. The nanoparticle may be capable of being activated from an initial state to an activated state, where the nanoparticle does not impact the effectiveness of the drag reducing agent when the nanoparticle is in the initial state and where the nanoparticle alters the physical characteristics of the drag reducing agent when the nanoparticle is activated. The nanoparticle may be added to the initial formulation of the drag reducing agent and a second nanoparticle may be added at the end of its usefulness, where the reaction of these particles may achieve the destruction of the drag reducing agent molecules. The nanoparticle may be remotely detectable.

In a second aspect, the invention relates to a method of removing drag reducer additive molecules from a pipeline stream, the method comprising: attaching one or more nanoparticles to each drag reducer additive molecule at various intervals in the use process; and using the nanoparticle to either destroy the drag reducer additive molecule or to remove the drag reducer additive molecule from the pipeline stream. Attaching the nanoparticles to the drag reducer additive molecules may comprise adsorption, chemical bonding, electrostatic adhesion, magnetic attraction, dusting, or ionic attraction. This may occur during manufacture of the drag reducer additive molecules. If so, using the nanoparticles may comprise activating the nanoparticles, which may cause the nanoparticles to reduce the size of the drag reducer additive molecules. Alternately, activating the nanoparticles may cause the nanoparticles to cause the drag reducer additive molecules to agglomerate, where they may be removed physically. Activating the nanoparticles may be accomplished through heat, light, magnetic fields, frequencies, vibration, filtering, chemicals, or other nanoparticles. If the nanoparticles are not attached during manufacture of the drag reducer additive molecules, attaching the nanoparticles to the drag reducer additive molecules may occur immediately prior to using the nanoparticle to either destroy the drag reducer additive molecule or to remove the drag reducer additive molecule from the pipeline stream.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to nanoparticles used with long chain poly-alpha-olefins, commercially known as drag reducer additives (DRA). The nanoparticles may be embedded in the original DRA formulation. Additionally or alternately, nanoparticles may be added at some point in the pipeline application. The nanoparticles may be used to destroy the DRA polymer by cleaving or interrupting or restructuring or otherwise breaking its bonds. Alternately, the nanoparticles may be used to agglomerate or coagulate the DRA polymer so that it can be removed mechanically or chemically.

The nanoparticles may be engineered or naturally occurring. The nanoparticles may be embedded or infused in the formulation of the DRA molecule during or after manufacturing by simple addition, absorption, chemical bonding, electrostatic adhesion, magnetic attraction, dusting, ionic attraction, or any other method of mating the nanoparticle to the DRA polymer or using the nanoparticles to primarily or secondarily form the long chain polymer. The nanoparticles may have characteristics that are detectable and may be changed by influencing elements such as heat, light, magnetic fields, changing frequencies, vibration, filtering, chemicals, some physically induced process, or by other nanoparticles. The nanoparticles may be initially inert, allowing the DRA to do its job. When altered, the nanoparticle may be capable of altering the DRA molecule, rendering it benign in size.

The nanoparticle may be activated by a frequency modulated conditioning that triggers an altered state of the nanoparticle, which would in turn rearrange the DRA molecule. Alternately, the nanoparticle may be activated by a magnetically induced energy field that would affect the same changes or by the addition of another nanoparticle. In all cases, the re-arranged molecule may not have to be removed from the stream, but rather would have a more acceptable molecular weight for motor fuel combustion.

Alternately, the nanoparticles may alter the DRA molecule such that the DRA may be removed physically, such as through filtering, centrifuging, absorbing, or flocculating.

Whereas, the devices and methods have been described in relation to the drawings and claims, it should be understood that other and further modifications, apart from those shown or suggested herein, may be made within the spirit and scope of this invention.

What is claimed is:

1. A method of removing drag reducer additive molecules from a pipeline stream, the method comprising:

attaching one or more nanoparticles to each drag reducer additive molecule during manufacture of the drag reducer additive molecules; and using the nanoparticle to either destroy the drag reducer additive molecule or to remove the drag reducer additive molecule from the pipeline stream.

2. The method of claim 1 where attaching the nanoparticles to the drag reducer additive molecules comprises adsorption, chemical bonding, electrostatic adhesion, magnetic attraction, dusting, or ionic attraction.

3. The method of claim 1 where using the nanoparticles comprises activating the nanoparticles.

4. The method of claim 3 where activating the nanoparticles causes the nanoparticles to reduce the size of the drag reducer additive molecules.

5. The method of claim 3 where activating the nanoparticles causes the nanoparticles to cause the drag reducer additive molecules to agglomerate.

6. The method of claim 3 where activating the nanoparticles is accomplished through heat, light, magnetic fields, frequencies, vibration, filtering, or chemicals.

7. The method of claim 1 where attaching the nanoparticles to the drag reducer additive molecules occurs immediately prior to using the nanoparticle to either destroy the drag reducer additive molecule or to remove the drag reducer additive molecule from the pipeline stream.

* * * * *